US011149336B2

(12) United States Patent
Veg et al.

(10) Patent No.: US 11,149,336 B2
(45) **Date of Patent: *Oct. 19, 2021**

(54) APPARATUS FOR THE CONTINUOUS HOT DIP COATING OF A METAL STRIP INCLUDING ROTATABLE POURING BOX AND ASSOCIATED METHOD

(71) Applicant: ArcelorMittal, Luxembourg (LU)

(72) Inventors: José Veg, Brenouille (FR); Didier Dauchelle, Creil (FR); Hubert Saint-Raymond, Metz (FR)

(73) Assignee: ARCELORMITTAL, Luxembourg (LU)

( * ) Notice: Subject to any disclaimer, the term of this patent is extended or adjusted under 35 U.S.C. 154(b) by 53 days.

This patent is subject to a terminal disclaimer.

(21) Appl. No.: 16/171,670

(22) PCT Filed: Apr. 26, 2017

(86) PCT No.: PCT/IB2017/052405

§ 371 (c)(1),
(2) Date: Oct. 26, 2018

(87) PCT Pub. No.: WO2017/187359

PCT Pub. Date: Nov. 2, 2017

(65) Prior Publication Data

US 2019/0144982 A1 May 16, 2019

(30) Foreign Application Priority Data

Apr. 26, 2016 (WO) ..... PCT/IB2016/052360

(51) Int. Cl.
*C23C 2/00* (2006.01)
*C23C 2/06* (2006.01)
(Continued)

(52) U.S. Cl.
CPC ..... *C23C 2/003* (2013.01); *C23C 2/02* (2013.01); *C23C 2/06* (2013.01); *C23C 2/12* (2013.01);
(Continued)

(58) Field of Classification Search
CPC ..... C23C 2/003
See application file for complete search history.

(56) References Cited

U.S. PATENT DOCUMENTS 3,592,160 A * 7/1971 Schwieterman ..... C23C 2/38 118/65
4,752,508 A * 6/1988 Sippola ..... C23C 2/14 427/433
(Continued)

FOREIGN PATENT DOCUMENTS

FR 2816639 A1 5/2002
JP H0728958 U 5/1995
(Continued)

*Primary Examiner* — Karl Kurple
(74) *Attorney, Agent, or Firm* — Davidson, Davidson & Kappel, LLC

(57) ABSTRACT

An apparatus for the continuous hot dip coating of a metal strip is provided. The apparatus includes a vessel intended to contain a liquid metal bath, a bottom roller and a displacement casing for the metal strip. The casing includes an upper portion and a lower portion. The lower portion includes a pouring box delimiting at least two liquid metal pouring compartments. Each pouring compartment is inwardly delimited by an inner wall including an upper rim. The casing is provided with the pouring box, is rotatable relative to the metal strip around a first rotation axis and the pouring box is rotatable relative to the upper portion of the casing around a second rotation axis. A method for coating the metal sheet is also provided.

36 Claims, 7 Drawing Sheets

(51) Int. Cl.

| | |
|---|---|
| ***C23C 2/12*** | (2006.01) |
| ***C23C 2/30*** | (2006.01) |
| ***C23C 2/20*** | (2006.01) |
| ***C23C 2/40*** | (2006.01) |
| ***C23C 2/02*** | (2006.01) |
| *C23C 2/10* | (2006.01) |
| *C23C 2/08* | (2006.01) |

(52) U.S. Cl.
CPC ..... *C23C 2/20* (2013.01); *C23C 2/30* (2013.01); *C23C 2/40* (2013.01); *C23C 2/08* (2013.01); *C23C 2/10* (2013.01)

(56) References Cited

U.S. PATENT DOCUMENTS

| | | | | |
|---|---|---|---|---|
| 6,923,864 | B2 | 8/2005 | Dauchelle et al. | |
| 6,936,307 | B2 | 8/2005 | Dauchelle et al. | |
| 9,745,653 | B2 | 8/2017 | Schaffrath et al. | |
| 2004/0028832 | A1* | 2/2004 | Dauchelle | C23C 2/00 427/431 |
| 2004/0052959 | A1* | 3/2004 | Dauchelle | C23C 2/00 427/431 |
| 2012/0180721 | A1* | 7/2012 | Hoshino | C23C 2/003 118/68 |
| 2016/0102393 | A1* | 4/2016 | Schaffrath | C23C 2/40 118/713 |
| 2019/0062888 | A1* | 2/2019 | Saint-Raymond | C22C 18/04 |

FOREIGN PATENT DOCUMENTS

| | | | |
|---|---|---|---|
| JP | 2000265217 | A | 9/2000 |
| JP | 2012021206 | A | 2/2012 |
| KR | 101533212 | B1 | 7/2015 |
| WO | 0238823 | A1 | 5/2002 |
| WO | 2014173663 | A1 | 10/2014 |

* cited by examiner

APPARATUS FOR THE CONTINUOUS HOT DIP COATING OF A METAL STRIP INCLUDING ROTATABLE POURING BOX AND ASSOCIATED METHOD

The invention relates to an apparatus for the continuous hot dip coating of a metal strip.

BACKGROUND

Patent application WO 02/38823 describes a coating apparatus including a displacement casing for the metal strip in a protective atmosphere and whose lower end is immersed in the liquid metal bath to determine with the surface of said bath and inside this casing, a liquid metal seal. The casing delimits, at its lower end, at least two compartments for pouring liquid metal, in which liquid metal from the bath is poured from the liquid seal in order to clean the liquid seal of impurities that may create flaws in the coating of the strip. The casing includes a stationary upper portion and a movable lower portion connected to one another by a bellows. To adjust the position of the movable portion relative to the strip and the horizontality of the movable portion, the lower portion is movable relative to the upper portion via two jacks. The nature of the movement of the movable portion, rotation and/or translation, as well as its amplitude, are controlled by adjusting the relative travels of the rods of the two jacks.

Such an apparatus is not fully satisfactory. Indeed, the adjustment mechanism is complicated to use and does not allow very precise positioning of the lower portion with respect to the upper portion. Furthermore, the connection of the lower portion to the upper portion via the bellows modifies the thermal deformation behavior of the upper portion.

Patent application KR 10-1533212 describes a coating apparatus including a displacement casing for a metal strip whose lower end is immersed in the liquid metal bath to determine with the surface of said bath and inside this casing, a liquid metal seal. The casing includes, at its lower end, a pouring box delimiting two compartments for pouring liquid metal, in which liquid metal from the bath is poured from the liquid seal. The casing is rotatable relative to the metal strip around a rotation axis via an articulation shaft A1 formed near an upper end of the casing. The casing is also connected to a chassis of the apparatus via a transfer device 10 including an articulation shaft A11. The articulation shafts A1 and A11 are movable in horizontal translation via respective transfer devices 10.

According to KR 10-1533212, the horizontal translation of the articulation shafts A1 and A11 in the forward direction makes it possible, in a single movement of the casing, to position the strip at the center of the pouring box in a configuration in which the upper surface of the pouring box is parallel to the surface of the molten metal bath.

Such an apparatus is not fully satisfactory. Indeed, due to the location of the single rotation axis A1 near the upper end of the casing, relatively substantial movements are necessary to adjust the position of the pouring box, which is not desirable given the congestion of the zone surrounding the casing.

SUMMARY OF THE INVENTION

An object of the invention is to provide a coating apparatus making it possible to perform positioning of the casing relative to the strip and balancing of the flow rates more flexibly and precisely, while limiting the amplitude of movement required.

The present invention provides a coating apparatus, including:

- a vessel intended to contain a liquid metal bath,
- a bottom roller arranged in the vessel and intended to be immersed in the liquid metal bath,
- a displacement casing for the metal strip, the lower end of which is immersed in the liquid metal bath to determine, with the surface of said bath and the inside of said duct, a liquid metal seal, the casing including an upper portion and a lower portion, said lower portion bearing a pouring box delimiting at least two liquid metal pouring compartments, each pouring compartment being inwardly delimited by an inner wall, the inner wall including an upper rim, the upper rim of each inner wall being intended to be arranged below the liquid seal surface to produce a flow from said surface in each of said pouring compartments, the casing provided with the pouring box being rotatable relative to the metal strip around a first rotation axis; and the pouring box being rotatable relative to the upper portion of the casing around a second rotation axis.

Additional features of the coating apparatus may include one or more of the following:

- the articulation allowing the rotation of the pouring box relative to the upper portion of the casing is a pivot link;
- the distance between the second rotation axis A2 and each of the upper rims of the inner walls is less than or equal to 2500 mm;
- the second rotation axis is substantially parallel to the first rotation axis;
- the apparatus further includes a pump configured to extract the liquid metal from the pouring compartments, at least one suction tubing, connecting each pouring compartment of said pump and a discharge tubing, intended to discharge the liquid metal from the pouring compartments into the liquid metal bath, the pump and the suction and discharge tubings being mounted stationary relative to the pouring box;
- the apparatus further includes a first actuator configured to rotate the casing around the first rotation axis relative to the strip, and a second actuator, configured to rotate the pouring box relative to the upper portion of the casing around the second rotation axis;
- the apparatus further includes an incline sensor, configured to measure the incline angle of the pouring box relative to the horizontal.
- the apparatus further includes control means for the second actuator based on the incline angle measured by the incline sensor;
- the apparatus further includes a tool for viewing the position of the inner walls of the pouring compartments relative to the strip;
- the apparatus further includes means for viewing the level of liquid metal in the pouring compartments, the viewing means including a reservoir arranged outside the casing and connected to the base of each of the pouring compartments by at least one connecting pipe, said reservoir being mounted stationary relative to the pouring box;
- the apparatus further includes means for adjusting the horizontality of the upper rims of the inner walls of the pouring boxes;
- the pouring box is stationary relative to the lower portion of the casing and the lower portion of the casing is mounted rotatable around the second rotation axis on the upper portion of the casing;

the outer walls of the pouring box are formed by side walls of the lower portion of the casing;

the second rotation axis is configured so as to be located outside the liquid metal bath;

the articulation allowing the rotation of the pouring box relative to the upper portion of the casing is a pivot link, said pivot link including an upper articulation arm secured to the upper portion of the casing and a lower articulation arm secured to the lower portion of the casing, said upper and lower articulation arms being rotatably connected via a shaft segment;

the pouring box is rotatably mounted on the lower portion of the casing;

the pouring box is inserted into the casing at a lower end thereof;

one from among the lower portion of the casing and the pouring box includes rotational guide bearings and the other from among the lower portion of the casing and the pouring box includes journals, each journal being received in a respective guide bearing so as to provide the rotational guiding of the pouring box around the second rotation axis;

the second rotation axis is immersed in the liquid metal bath;

the apparatus further includes a sealing gasket arranged between the pouring box and the lower portion of the casing in order to prevent liquid metal from penetrating between the pouring box and the casing;

the second rotation axis is arranged below the upper rims of the pouring compartments when the pouring box is horizontal;

the rear pouring compartment, located on the side of the face of the metal strip placed opposite the bottom roller, is outwardly delimited by an outer wall, said outer wall forming, in the usage configuration of the coating apparatus, an angle strictly greater than zero with the passage plane of the strip;

the outer wall of the rear pouring compartment is vertical in the usage configuration of the coating apparatus.

The present invention also provides a method for continuous hot dip coating of a metal strip using a coating apparatus as cited above, including:

a step for positioning the pouring box relative to the metal strip, including rotating the casing and the pouring box around the first rotation axis so as to position the steel strip relative to the upper rims of the pouring compartments; then a rebalancing step, including rotating the pouring box around the second rotation axis relative to the upper portion of the casing so as to make the pouring box horizontal.

Additional features of the method may include one of more the following:

the method further includes a step for adjusting the horizontality of the upper rims of the inner walls of the pouring compartments;

during the coating method, a coating comprising zinc and aluminum, in particular an Aluminum-Zinc coating, for example comprising 55 wt % of aluminum, 43.5 wt % of zinc and 1.5 wt % of silicon, is deposited on the metal strip;

during the coating method, a zinc-based coating comprising aluminum is deposited on the metal strip;

during the coating method, a coating comprising between 0.1 and 0.3% aluminum is deposited on the metal strip;

during the coating method, a coating comprising 5% aluminum, the rest being zinc, is deposited on the metal strip;

during the coating method, a zinc-based coating comprising magnesium and optionally aluminum, and preferably comprising from 0.1 to 20 wt % of aluminum and from 0.1 to 10 wt % of magnesium, is deposited on the metal strip;

during the coating method, an aluminum-based coating comprising silicon and iron, in particular a coating having the following composition:

$$8\% \leq Si \leq 11\%$$

$$2\% \leq Fe \leq 4\%,$$

the rest being aluminum and possible impurities, is deposited on the metal strip.

BRIEF DESCRIPTION OF THE DRAWINGS

The invention will be better understood upon reading the following description, provided solely by way of example, and in reference to the drawings, in which.

DETAILED DESCRIPTION OF THE DRAWINGS

Figure 1:
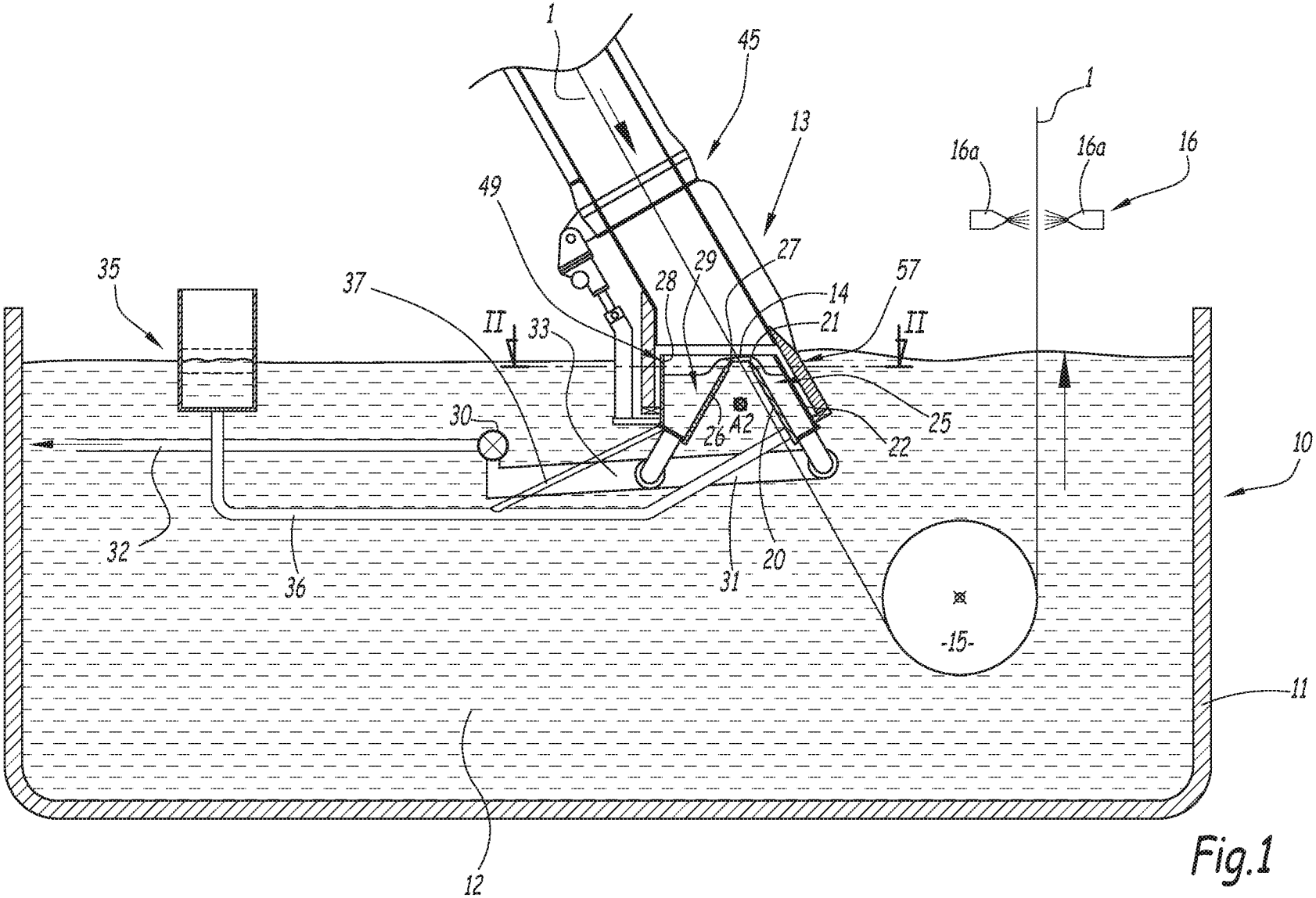
FIG. 1 is a general schematic view of a coating apparatus according to a first embodiment of the invention.

Hereinafter, the description will be described for an apparatus for continuous galvanizing of a metal strip 1. However, the invention applies to any method for continuous hot dip coating in which surface pollution appears and for which a clean liquid seal must be retained.

In particular, it may advantageously be implemented for depositing coatings comprising zinc and aluminum, in particular aluminum-based coatings comprising zinc, called Aluminum-Zinc coatings, for example comprising 55 wt % of aluminum, 43.5 wt % of zinc and 1.5 wt % of silicon, such as the Aluzinc® sold by ArcelorMittal or zinc-based coatings comprising aluminum, and in particular zinc-based coatings comprising 0.1 to 0.3% aluminum, called GI coatings, or coatings comprising 5% aluminum, the rest being zinc and possible impurities.

The apparatus may also be used to deposit zinc-based coatings comprising magnesium, called Zinc-Magnesium or Zn—Mg coatings. Advantageously, such coatings further comprise aluminum, and are then called Zinc-Aluminum-Magnesium or Zn—Al—Mg coatings. Advantageously, the galvanizing apparatus 1 is provided for depositing Zn—Al—Mg coatings comprising from 0.1 to 20 wt % of aluminum and from 0.1 to 10 wt % of magnesium.

The apparatus 10 may also be used to deposit aluminum-based coatings comprising silicon, in particular for depositing coatings having the following composition:

$$8\% \leq Si \leq 11\%$$

2%≤Fe≤4%, the rest being aluminum and possible impurities.

The metal strip 1 is in particular a strip made from steel. However, it could be made from other metal materials.

First, upon leaving the cold rolling train, the metal strip 1 enters an annealing furnace, not shown, in order to recrystallize it after the significant workhardening related to the cold rolling, and to prepare its chemical surface state in order to promote the chemical reactions necessary for the galvanizing operation. In this furnace, the metal strip 1 is brought to a temperature for example between 650 and 900° C.

Upon leaving the annealing furnace, the metal strip 1 enters a galvanizing apparatus shown in FIG. 1 and designated by general reference 10.

This apparatus 10 comprises a vessel 11 containing a liquid metal bath 12.

The composition of the liquid metal bath 12 depends on the composition of the coating that one wishes to deposit on the strip 1. Aside from zinc, magnesium and/or aluminum in appropriate proportions, depending on the coating to be deposited, the bath 12 may also contain up to 0.3 wt % of optional additional elements such as Si, Sb, Pb, Ti, Ca, Mn, Sn, La, Ce, Cr, Ni or Bi. These various additional elements may in particular make it possible to improve the ductility or adhesion of the metal coating on the strip 1. One skilled in the art who knows their effects on the characteristics of the metal coating will know how to use them based on the complementary aim sought. The bath 12 may lastly contain residual elements coming from the supplied ingots or resulting from the passage of the strip 1 in the bath 12, source of inevitable impurities in the metal coating.

The temperature of the liquid metal bath 12 is generally between 400 and 700° C.

Upon leaving the annealing furnace, the metal strip 1 is cooled to a temperature close to that of the liquid metal bath 12 using exchangers and is next immersed in the bath 12.

As shown in FIG. 1, the coating apparatus 10 comprises a casing 13 inside which the metal strip 1 travels under a protective atmosphere with respect to the metal from which it is made.

During the use of the apparatus 10, the metal strip 1 travels through the casing 13 along a predefined passage plane.

This casing 13, also called "immersion tunnel" or "snout", has a rectangular cross-section in the example embodiment shown in the Figures.

The casing 13 is immersed, at its lower portion, in the bath 12 so as to determine a liquid seal 14 with the surface of said bath 12 and inside said casing 13. Thus, the strip 1, upon being immersed in the liquid bath 12, passes through the surface of the liquid seal 14 in the casing 13.

The metal strip 1 is deflected by a roller 15, commonly called bottom roller and arranged in the bath 12.

The predefined passage plane of the metal strip 1 through the casing 13 is in particular determined by the geometry of the bottom roller 15 and of an upper roller (not shown) located upstream from the casing 13, as well as by the relative positions of these two rollers.

The bottom roller 15 and the upper roller thus form means for displacing the metal strip along the predetermined passage plane.

At the outlet of said bath 12, the coated strip 1 passes in wiping means 16 that are for example made up of nozzles **16*a* for spraying gas, such as nitrogen or air, and that are oriented toward each face of the strip 1** to regulate the thickness of the liquid metal coating.

Figure 3:
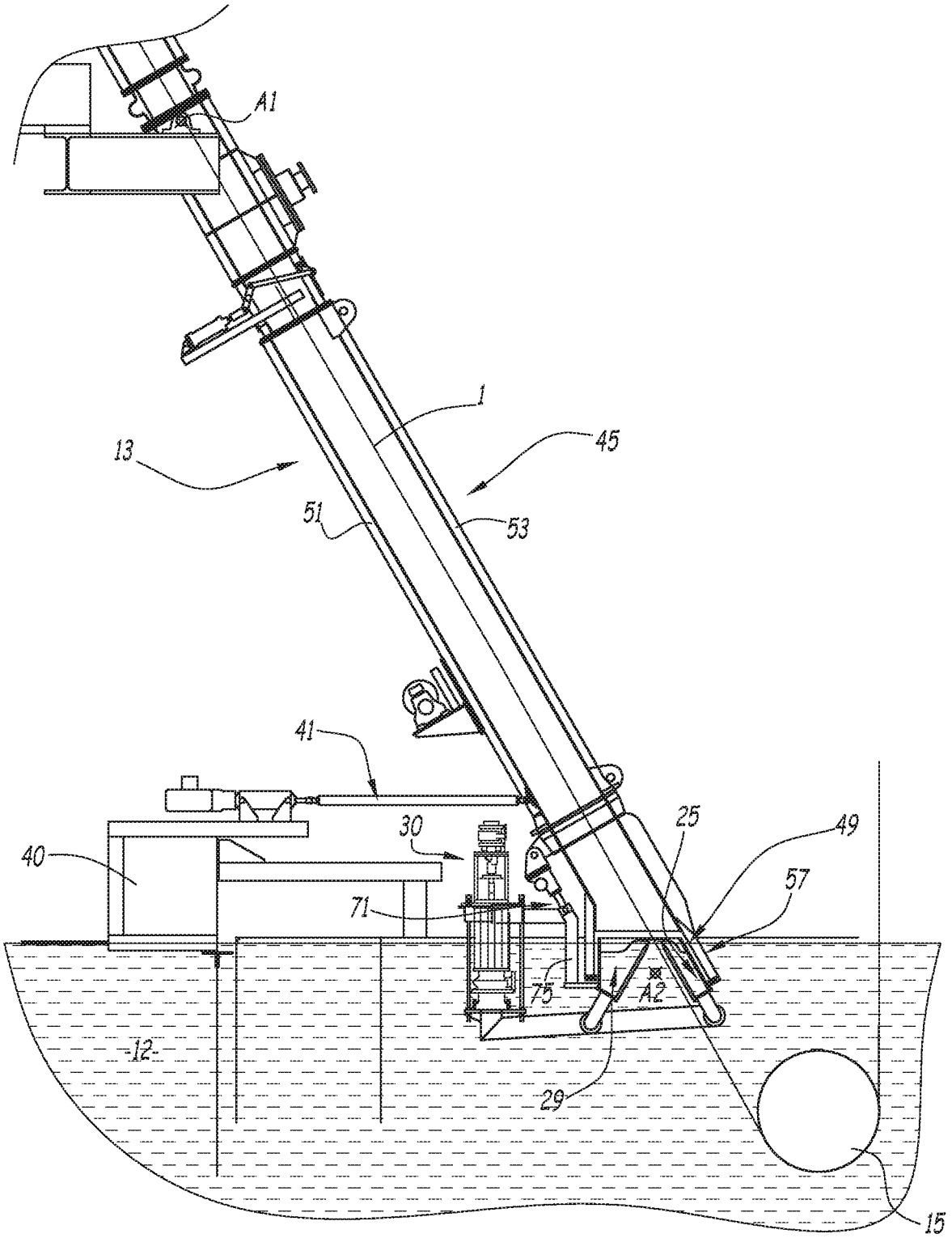
FIG. 3 is a schematic view of the coating apparatus of FIG. 1, illustrating certain aspects in more detail.
Figure 5:
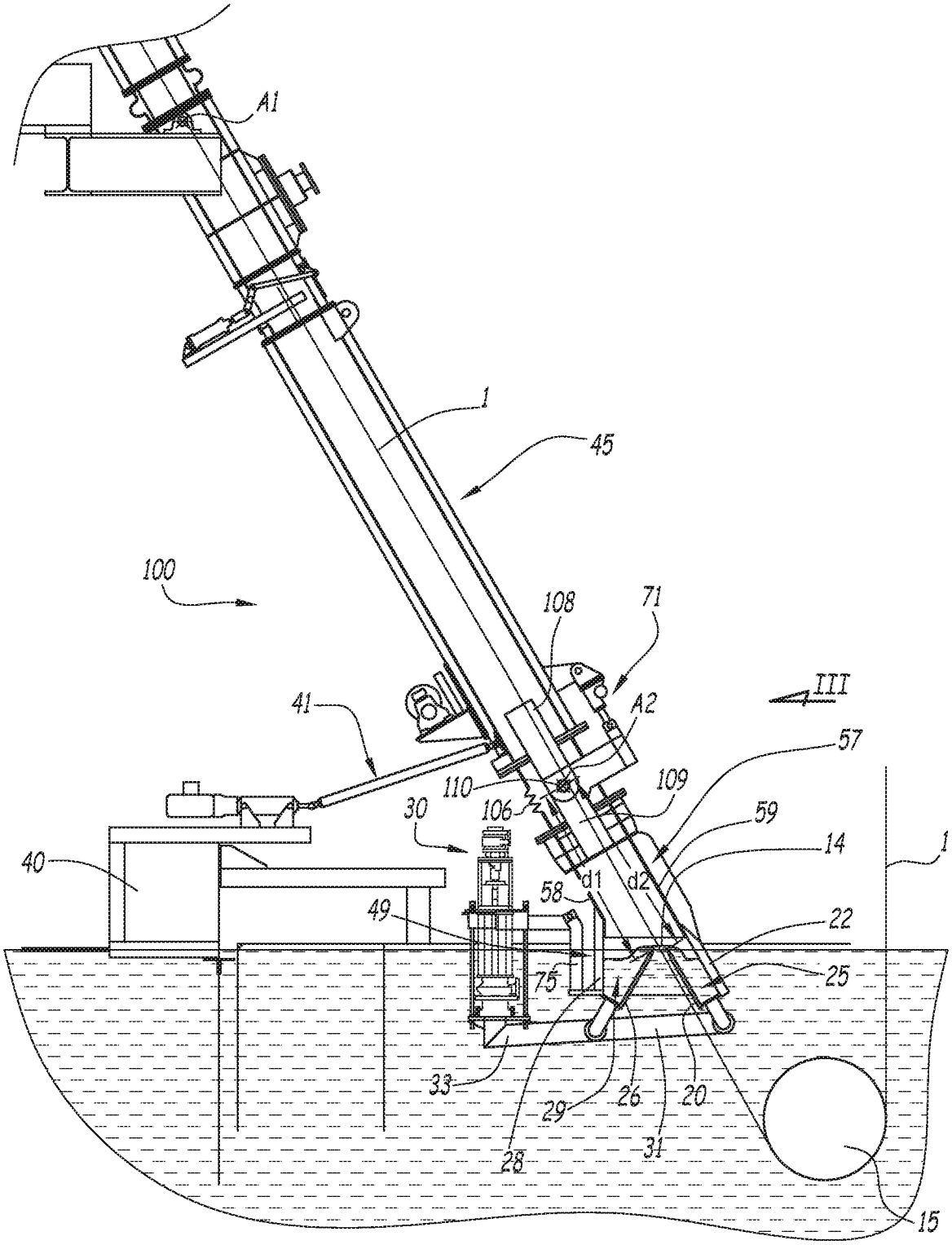
FIG. 5 is a schematic view of part of a coating apparatus according to a second embodiment.

As shown in FIGS. 1, 3 and 5, the casing 13 bears, at its lower end, a pouring box 49 delimiting two compartments 25, 29 for pouring liquid metal. The compartments 25, 29 are located laterally inside the casing 13.

More particularly, the pouring box 49 includes a front compartment 25 for pouring liquid metal, located facing the face of the strip 1 located on the side of the bottom roller 15. The front compartment 25 is inwardly delimited by an inner wall 20 oriented toward the surface of the liquid seal 14, and outwardly by an outer wall 22. The outer wall 22 extends facing the face of the strip 1 located on the side of the bottom roller 15. It is formed by an outer wall of the pouring box 49.

The upper rim 21 of the inner wall 20 is positioned below the surface of the liquid seal 14 and the compartment 25 is provided with means for keeping the level of liquid metal in said compartment 25 at a level below the surface of the liquid seal 14 in order to produce a natural flow of liquid metal from said surface of said seal 14 toward said compartment 25.

Likewise, the pouring box 49 includes a rear compartment 29 for pouring liquid metal, located facing the face of the strip 1 which is not located on the side of the bottom roller 15. The rear compartment 29 is inwardly delimited by an inner wall 26 oriented toward the surface of the liquid seal 14, and outwardly by an outer wall 28. The outer wall 26 extends facing the face of the strip 1 which is not located on the side of the bottom roller 15. It is formed by an outer wall of the pouring box 49.

The upper rim 27 of the inner wall 26 is positioned below the surface of the liquid seal 14 and the compartment 29 is provided with means for keeping the level of liquid metal in said compartment 29 at a level below the surface of the liquid seal 14 in order to produce a natural flow of liquid metal from said surface of said liquid seal 14 toward said compartment 29.

Figure 2:
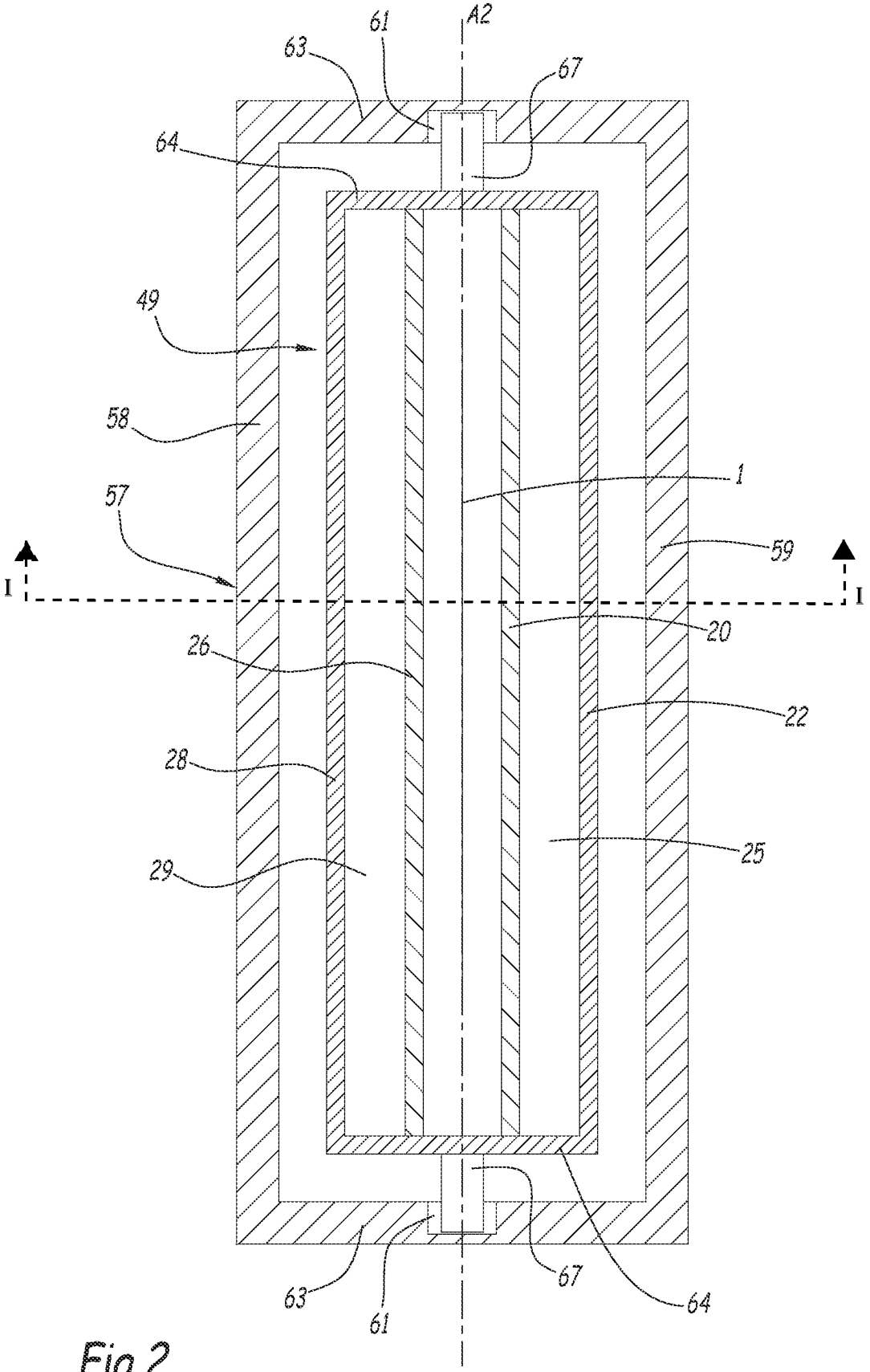
FIG. 2 is a top view along plane II-II of FIG. 1.

As shown in FIG. 2, the outer walls 22, 28 are connected to one another by side walls 64 extending facing edges of the strip 1. Plane I-I in FIG. 2 illustrates where the cross-section of FIG. 1 is viewed from with respect to the portion shown in FIG. 2.

Throughout the following description, these two compartments 25, 29 communicate with one another to form a single peripheral compartment. It is of course completely possible to separate them using side walls, as well as to add side compartments facing the edges of the strip 1 to be coated.

Advantageously, the fall height of the liquid metal into the compartments 25 and 29, i.e., the distance along a vertical direction between the upper rims 21, 27 and the liquid metal level in the compartments 25, 29, is determined to prevent the metal oxide particles and inter-metallic compounds from rising countercurrent with respect to the flow of the liquid metal. This fall height may be greater than or equal to 40 mm, or even greater than or equal to 50 mm, and preferably greater than or equal to 100 mm.

As illustrated in FIG. 1, the means for maintaining the liquid metal level in the pouring compartments 25 and 29 include at least one pump 30 connected on the suction side to said compartment 25 and 29 by a suction tubing, respectively 31 and 33. The pump 30 is provided on the discharge side with a discharge tubing 32, configured to discharge the liquid metal withdrawn by the pump 30 in the volume of the bath 12.

Furthermore, the apparatus 10 comprises means for detecting the liquid metal level in the pouring compartments 25, 29.

Advantageously, said detection means are formed by a reservoir 35 arranged outside the casing 13 and the compartments 25, 29, and connected to the base of each of the compartments 25 and 29 by a connecting pipe, respectively 36 and 37. In another embodiment, it is possible to use a single connecting pipe.

As shown in FIG. 1, the connecting point of the pump 30 on the pouring compartments 25 and 29 is located above the connecting point of the reservoir 35 on said compartments 25 and 29.

The addition of the external reservoir 35 makes it possible to duplicate the level of the pouring compartments 25 and 29 on the outside of the casing 13 in a favorable environment so as to detect this level easily. To that end, the reservoir 35 may be equipped with a liquid metal level detector, for example a contactor feeding an indicator, a radar or a laser beam.

Alternatively, any other means making it possible to detect the liquid metal level in the pouring compartments 25, 29 may be used.

The continuous detection of the liquid metal level in the pouring compartments 25 and 29 makes it possible to adjust this level so as to keep it below the surface of the liquid seal 14, while advantageously respecting the fall height described above.

Advantageously, the pump 30 is adjusted to a predetermined constant flow rate and the adjustment of the liquid metal level is done by introducing metal ingots into the vessel 11 when the detected liquid metal level is below a predetermined level. It is also possible to use a variable-flow pump that allows, in combination with the means for detecting the equipment level in the pouring compartments 25, 29, a faster adjustment of the galvanizing conditions.

Figure 4:
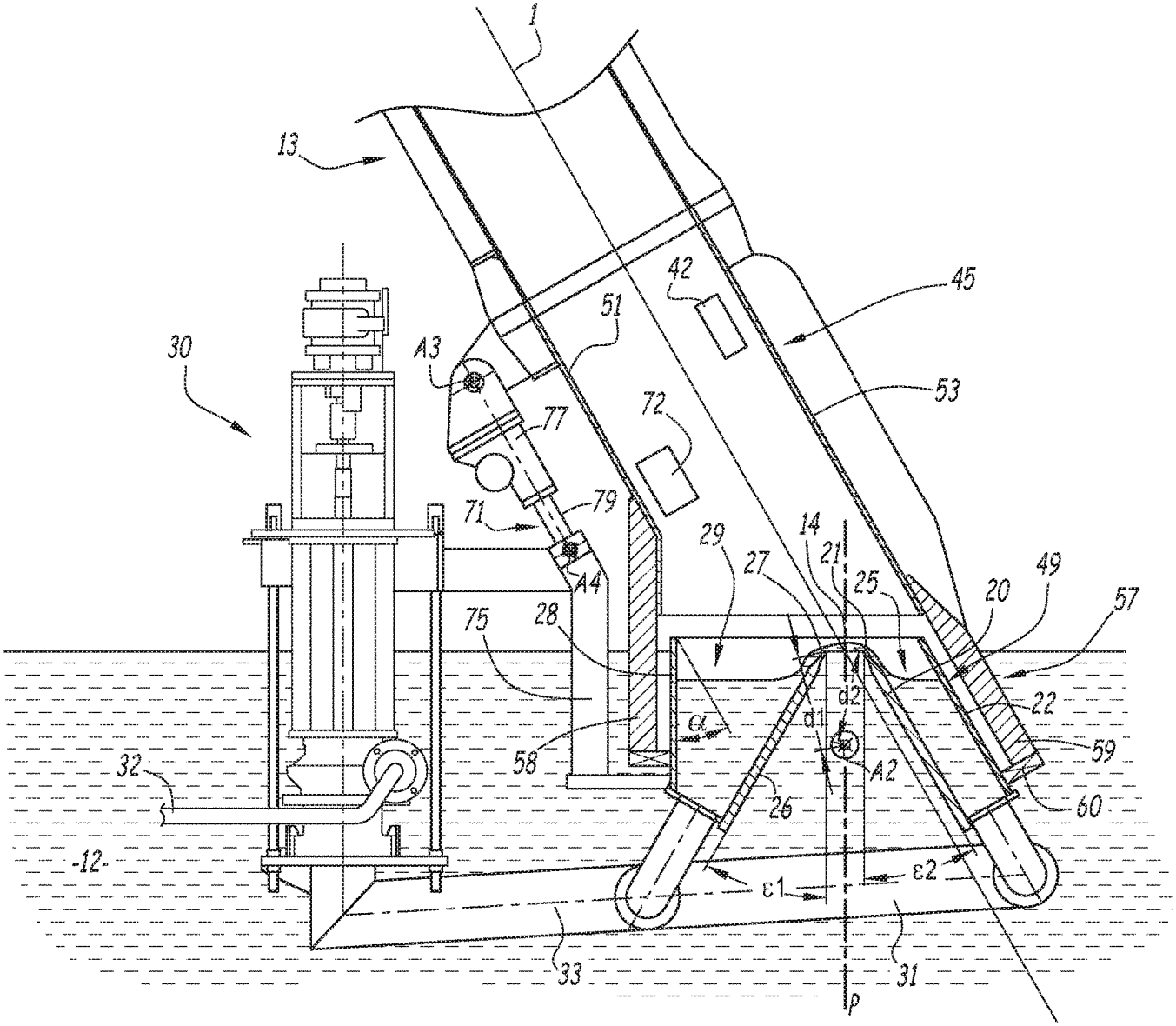
FIG. 4 is an enlarged view of a detail of FIG. 3.

As shown in FIG. 4, the casing 13 includes an upper part 45 and a lower part 57 at least partially immersed in the liquid metal bath 12.

In the illustrated embodiment, the upper part 45 includes two side walls 51, 53 substantially parallel to one another, and substantially parallel to the passage plane of the strip 1.

The pouring box 49 is carried by the lower portion 57 of the casing 13. More particularly, as shown in FIG. 4, the pouring box 49 is inserted into the lower end of the lower portion 57 while extending partially inside the casing 13. It protrudes downwardly past the lower end of the casing 13.

Advantageously, the apparatus 10 includes a sealing gasket 60 arranged between the lower end of the casing 13 and the pouring box 49 so as to prevent liquid metal from the bath 12 from penetrating between these two elements. As an example, the sealing gasket 60 is formed by a bellows secured to the pouring box 49 by one of its ends, and in particular by its lower end, and to the casing 13 by the other of its ends, in particular by its upper end. Such a bellows is for example made from steel. Such a bellows makes it possible to produce the sealing between the pouring box 49 and the casing 13 while allowing a relative rotation between these two parts.

As shown in FIG. 3, the casing 13 and the pouring box 49 are rotatable jointly around a first rotation axis A1. The pouring box 49 and the casing 13 are fixed in rotation around the first rotation axis A1. The first rotation axis A1 is substantially horizontal.

The rotation of the casing 13 and the pouring box 49 around the first rotation axis A1 results in a change in the distance between the upper rims 21, 27 of the pouring compartments 25, 29 and the metal strip 1, and thus allows a positioning of the strip 1 relative to said rims 21, 27.

The pouring box 49 is further rotatable relative to the upper portion 45 of the casing 13 around a second rotation axis A2.

The second rotation axis A2 is substantially horizontal.

More particularly, as shown in FIG. 2, the second rotation axis A2 is oriented so as to pass through the walls of the casing 13.

In particular, the distance d1, d2 between the second rotation axis A2 and each of the rims 21, 27 of the pouring compartments 25, 29 is less than or equal to 2500 mm. This distance is advantageously comprised between 0 mm and 400 mm.

In this embodiment, the second rotation axis A2 is located below the upper rims 21, 27.

The first and second rotation axes A1, A2 are parallel to one another.

The rotation of the pouring box 49 around the second rotation axis A2 makes it possible to adjust the horizontality of the pouring box 49 independently of the rotational movement potentially performed around the first rotation axis A1 by the assembly made up of the casing 13 and the pouring box 49.

The particular location of the second rotation axis A2 makes it possible to perform this adjustment through a particularly small movement amplitude, in particular of the order of a few degrees.

The pouring box 49 is considered to be horizontal when the upper rims 21, 27 are located in a same horizontal plane defined with a tolerance of plus or minus 5 mm. In other words, a maximum altitude difference of 10 mm is tolerated between the two upper rims 21 and 27.

Optionally, the casing 13 is also translatable along its longitudinal axis so as to adjust its immersion height in the liquid metal bath 12, for example using a bellows system. Such an adjustment mechanism is known and will not be described in detail.

The apparatus 10 also includes a mechanism for adjusting the horizontality of the upper rims 21, 27. More particularly, the mechanism for adjusting the horizontality of the upper rims 21, 27 is configured to adjust the horizontality of the second rotation axis A2.

More particularly, the pouring box 49 is articulated on the casing 13 via a pivot link allowing the rotation of the pouring box 49 relative to the casing 13 around the second rotation axis A2. Such a pivot link includes a pivot, for example in the form of a shaft, shaft segment or journal received in a bearing, the pivot extending along the second rotation axis A2. The pivot is formed on the casing 13.

As illustrated in FIGS. 1 to 4, the pouring box 49 forms a separate part from the casing 13. It is mounted rotatable on the lower portion 57 of the casing 13. As can be seen in FIG. 2, the pouring box 49 is mounted rotating on the lower portion 57 of the casing 13 via journals 67, mounted rotatable in rotational guide bearings 61. The journals 67 define the rotation axis A2.

In the illustrated embodiment, the journals 67 are formed on the pouring box 49 and the bearings 61 are formed on the casing 13. More particularly, the rotational guide bearings 61 are formed in the lower portion 57 of the casing 13, while being arranged on two opposite faces 63 of the casing 13. They are substantially coaxial with the axis A2. Each guide bearing 61 receives a respective journal 67 formed on the pouring box 49.

Figure 7:
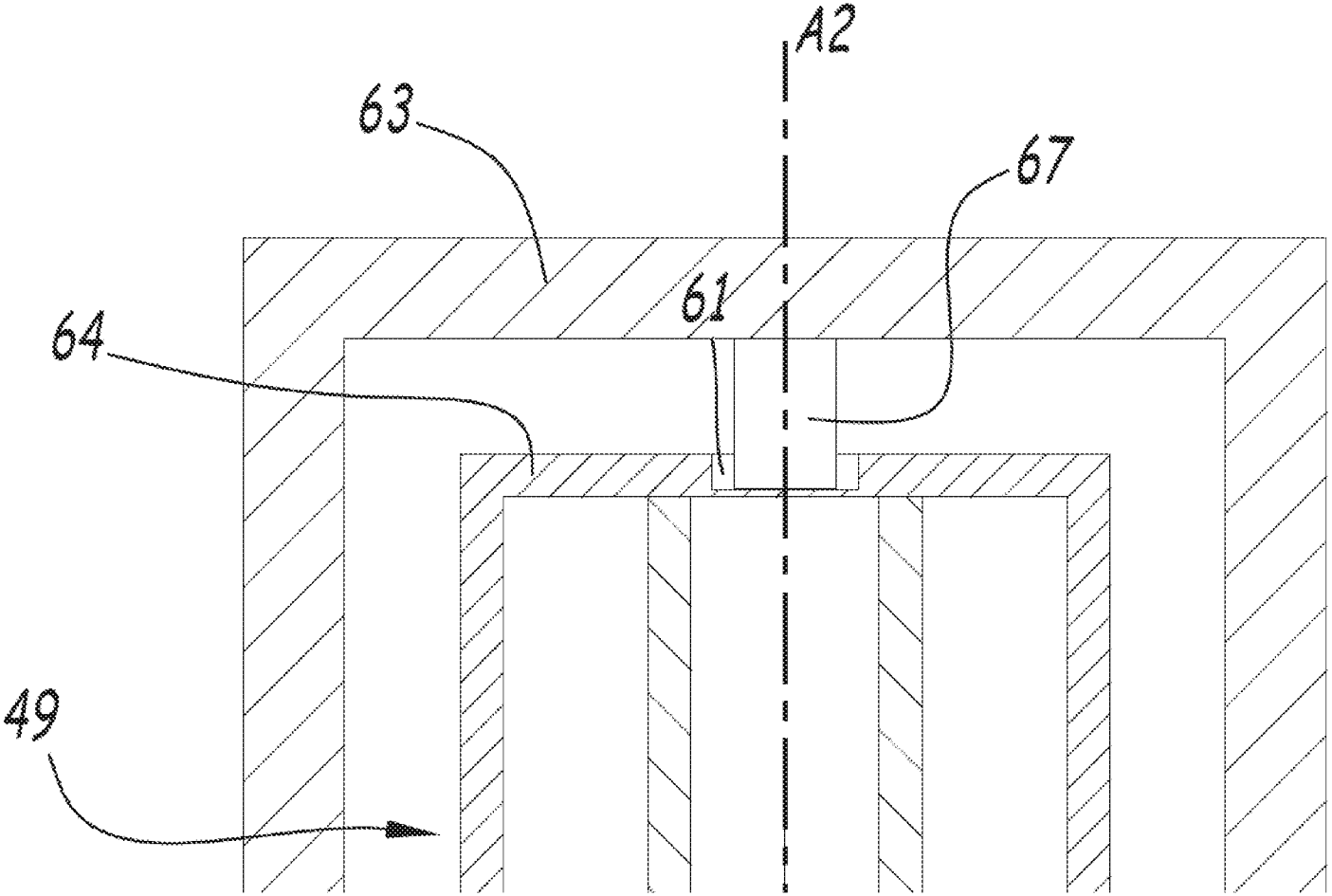
FIG. 7 shows an embodiment with journals are formed on the casing and the guide bearings formed on the pouring box.

Alternatively, the journals 67 are formed on the casing 13, and more particularly in its lower portion 57, and the guide bearings 61 are formed on the pouring box 49, as shown in FIG. 7.

In the apparatus 10 according to the first embodiment, the second rotation axis A2 is immersed in the liquid metal bath 12. More particularly, the second rotation axis A2 passes between the two pouring compartments 25, 29, while being arranged below the upper rims 21, 27 of the pouring compartments 25, 29. Such positioning of the second rotation axis A2 is advantageous, since it results in a relatively small rotation radius of the upper rims 21, 27 around the second rotation axis, which facilitates the precise adjustment of the horizontality of the pouring box 49.

As can be seen in FIG. 3, the apparatus 10 includes a first actuator 41, configured to rotate the casing 13 around the first rotation axis A1 relative to the strip 1.

In the illustrated embodiment, the first actuator 41 assumes the form of an actuating jack. This actuating jack is arranged between a stationary frame 40 of the apparatus 10 and the casing 13, more particularly the upper portion 45 of the casing 13. As illustrated in FIGS. 3 and 4, the first actuator 41 acts on the casing 13 at the lower end of the portion 45.

For example, the first actuator 41 is formed by a screw jack. However, alternatively, the first actuator 41 is of any other suitable type, and for example includes a hydraulic or pneumatic jack.

As can be seen in FIG. 4, the apparatus 10 advantageously further includes a tool 42 for viewing the relative distance between each of the upper rims 21, 27 of the pouring compartments 25, 29 and the metal strip 1. More particularly, the viewing tool 42 includes a camera arranged in the casing 13 so as to allow the simultaneous viewing of the upper rims 21, 27 and the edge of the strip 1. This viewing tool 42 has been shown only schematically in FIG. 4.

According to one embodiment, the apparatus 10 includes control means (not shown), configured to control the first actuator 41 from relative positions of the upper rims 21, 27 and the strip 1 that are determined using the viewing tool 42.

The apparatus 10 further includes a second actuator 71, configured to rotate the pouring box 49 around the second rotation axis A2 relative to the casing 13.

In the embodiment shown in FIGS. 3 and 4, the second actuator 71 assumes the form of an actuating jack, and in particular a screw jack. However, alternatively, the second actuator 71 is of any other suitable type, and for example includes a hydraulic jack.

Advantageously, the apparatus 10 further includes a measuring sensor 72 configured to measure the incline angle of the pouring box 49 relative to the horizontal. This measuring sensor 72 has been shown only schematically in FIG. 4.

Optionally, the apparatus 10 also includes control means (not shown) for the second actuator 71, configured to control the second actuator 71 based on the incline angle measured by the measuring sensor 72. More particularly, these control means are configured to control the rotation of the pouring box 49 relative to the casing 13 around the second rotation axis A2 until the pouring box 49 is oriented horizontally, i.e., until the upper rims 21, 27 are located in a same horizontal plane.

As illustrated in FIGS. 3 and 4, the apparatus 10 includes a support chassis 75 for the pouring box 49, as well as the pump 30 and ducts associated with the pump 30.

The support chassis 75 is fixed in rotation relative to the casing 13 around the first rotation axis A1. It is further fixed in rotation relative to the pouring box 49 around the second rotation axis A2.

The pump 30 is mounted stationary on said support chassis 75. As previously explained, the pump 30 is connected to the pouring compartments 25, 30 via suction tubings 31 and 33. These suction tubings 31, 33 are rigid ducts, mounted stationary on the pouring box 49 and on the pump 30. The discharge tubing 32 is also formed by a rigid duct mounted stationary on the pump 30. The suction tubings 31, 33 and the discharge tubing 32 are fixed in rotation relative to the pouring box 49 and the pump 30.

When the apparatus 10 includes a reservoir 35 for viewing the liquid metal level in the pouring compartments 25, 29 as previously defined, the latter is advantageously mounted stationary relative to the support chassis. Thus, the viewing reservoir 35 is fixed in rotation relative to the support chassis. It will be noted that in order to simplify FIGS. 3 and 4, the viewing reservoir 35 has been omitted from these Figures.

In FIGS. 3 and 4, the support chassis 75 is connected to the casing 13 via the jack 71 for rotating the pouring box 49. As illustrated more particularly in FIG. 4, in this particular embodiment, the body 77 of the jack 71 is mounted pivoting relative to the casing 13 around a rotation axis A3 parallel to the rotation axis A2, and the rod 79 of the jack 71 is connected to the support chassis 75 while being rotatable relative to the support chassis 75 around a rotation axis A4 parallel to the rotation axis A2. Thus, the variation in the length of the jack 71 causes the support chassis 75 and the pouring box 49 to rotate around the rotation axis A2.

The shape of the pouring compartments 25 and 29 will now be explained in more detail in view of FIG. 4.

In the apparatus 10 illustrated in FIGS. 1 to 4, the outer wall 28 of the rear pouring compartment 29 forms, in a usage configuration of the coating apparatus 10, an angle $\alpha$ strictly greater than 0° with the passage plane of the strip 1, and for example greater than or equal to 15°, and advantageously greater than or equal to 25°, or even greater than or equal to 30°. Indeed, it has been observed that the more the angle increases, the more the efficiency increases as well.

Usage configuration refers to the configuration of the coating apparatus 10 when the metal strip 1 travels through the apparatus 10 in order to be coated by passing in the liquid metal bath 12. In particular, in the usage configuration, the two upper rims 21, 27 of the two pouring compartments 25, 29 are located in a same horizontal plane.

The inventors of the present invention have noted that such a configuration of the outer wall 28 is particularly advantageous. In particular, it makes it possible to obtain, on the side of the face of the metal strip 1 facing the pouring compartment 29, a coating having a very low defect density, while limiting the bulk of the coating apparatus 10.

Indeed, they have noted that when the outer wall 28 of the rear pouring compartment 29 is oriented parallel to the metal strip 1, part of the liquid metal cascading in the pouring compartment 29 from the liquid metal seal surface 14 falls onto the outer wall 28 of the pouring compartment 29, then is projected on the face of the strip 1 facing the pouring compartment 29, thus creating appearance flaws on this face of the strip 1. This splashing phenomenon results from the fact that the outer wall 28 extends approximately perpendicular to the fall direction of at least part of said liquid metal cascade.

On the contrary, the orientation of the outer wall 28 as described above makes it possible to reduce such projections, and therefore results in a better appearance quality of the affected face of the strip 1. Indeed, in this case, the outer wall 28 extends more tangentially to the general flow direction of the cascade of liquid metal.

As illustrated in FIGS. 1 to 4, the outer wall 28 of the rear pouring compartment 29 is oriented so as to move away from the passage plane of the strip 1 from its upper end toward the bottom of the rear pouring compartment 29.

The angle $\alpha$ between the outer wall 28 and the passage plane of the strip 1 is strictly greater than 0° and may be less than, greater than or equal to $\alpha_0$, where $\alpha_0$ is the angle between the passage plane of the strip 1 and the vertical, knowing that the splash risk decreases when the angle $\alpha$ increases.

As an example, the outer wall 28 forms, with the passage plane of the strip 1, an angle $\alpha$ between $\alpha_0-10°$ and $\alpha_0+50°$, and more particularly between $\alpha_0$ and $\alpha_0+45°$.

A11 other things being equal, the splash risk is minimal when the outer wall 28 forms, with the strip 1, an angle $\alpha$ strictly greater than the angle $\alpha_0$ of the passage plane of the strip 1 with the vertical.

Preferably, the strip 1 forms an angle $\alpha_0$ with the vertical comprised between 25° and 50°. As an example, the strip 1 forms an angle $\alpha_0$ with the vertical approximately equal to 30°.

Advantageously, the inner wall 26 of the pouring compartment 29 is angled, from its upper rim 27 toward the bottom of the compartment 29, away from a median vertical plane P between the two rims 21, 27. In other words, the inner wall 26 of the pouring compartment 29 is angled, so as to move away from a vertical plane passing through the upper rim 27 from its upper rim 27 toward the bottom of the compartment 29. It forms, with the vertical, an angle ε 1 strictly greater than zero, as shown more particularly in FIG. 4.

Indeed, the inventors of the present invention have noted that such an incline made it possible to guide the flow of the liquid metal in the pouring compartment 29 globally along the inner wall 26 and thus to reduce the risks of splashing on the strip 1.

An incline by an angle ε1 greater than or equal to 15° is particularly advantageous to reduce the risks of splashing. As an example, the angle ci is greater than or equal to 20°, and more particularly greater than or equal to 25°.

On the contrary, when the inner wall 26 is inclined opposite the incline shown in the Figures of the present patent application, i.e., approaching said median vertical plane P toward the bottom of the compartment 29 or when the inner wall 26 is vertical, part of the liquid metal being poured into the compartment 29 risks falling substantially vertically directly into the liquid metal bath contained in the pouring compartment 29, which increases the risks of liquid metal being splashed onto the strip 1.

The outer wall 22 of the front pouring compartment 25 is oriented substantially parallel to the passage plane of the strip 1. In the case of the pouring compartment 25, which is located on the side of the face of the strip 1 placed facing the bottom roller 15, this orientation makes it possible to avoid splashing on the strip 1, the outer wall 22 extending substantially tangentially to the general flow direction of the cascade of liquid metal being poured into the compartment 25.

Advantageously, the inner wall 20 of the pouring compartment 25 is angled, from its upper rim 21 and toward the bottom of the compartment 25, away from the median vertical plane P previously defined, as shown more particularly in FIG. 4. In other words, the inner wall 26 of the pouring compartment 25 is angled, so as to move away from a vertical plane passing through the upper rim 21 from its upper rim 21 toward the bottom of the compartment 25. It forms, with the vertical, an angle ε2 strictly greater than zero.

Such an incline makes it possible to guide the flow of the liquid metal in the pouring compartment 25 globally along the inner wall 20 and thus to reduce the risks of splashing on the strip 1. An incline by an angle ε2 greater than or equal to 15° is particularly advantageous to reduce the risks of splashing.

Preferably, the angle ε2 is strictly greater than the angle $\alpha_0$ formed between the passage plane of the strip 1 and the vertical in order to prevent the strip 1 from rubbing on the inner wall 20 when it travels through the apparatus 10. For example, the angle ε2 is at least 3° greater than the angle $\alpha_0$. As an example, when the strip 1 forms an angle $\alpha_0$ of about 30° with the vertical, the angle ε2 is advantageously equal to about 35°. Such an angle also makes it possible to provide good guiding of the liquid metal along the inner wall 20.

According to one embodiment, the angles ci and ε2 are identical. They are for example equal to about 35°.

The inner 20, 26 and outer 28 walls of the pouring compartments 25, 29 are generally substantially flat. The aforementioned incline values are defined relative to the mean plane of the walls in question.

The angles $\alpha$, ε1 and ε2 are defined in the usage configuration of the coating apparatus.

As illustrated in FIGS. 1, 3 and 4, the inner walls 20 and 26 are preferably tapered at their upper rims 21, 27 to facilitate a flow along the wall 20, 26 and avoid splashing the strip 1.

As an example, the upper rims 21 and 27 of the inner walls 20 and 26 of the pouring compartments 25 and 29 comprise, in the longitudinal direction, a series of hollows and protrusions in the shape of an arc of a circle.

In the embodiment illustrated in FIGS. 1 to 4, in which the lower portion 57 of the casing 13 extends partially facing the pouring box 49, the side wall 58 of the lower portion 57 of the casing 13 is, as an example, parallel to the outer wall 28 of the rear pouring compartment 29 in its portion located facing said outer wall 28. Thus, this side wall 58 forms an angle with the side wall 51 of the upper portion 45, which extends substantially parallel to the passage plane of the metal strip 1. Such a configuration makes it possible to limit the bulk of the casing 13.

Advantageously, the outer wall 22 of the pouring compartment 25 and the side wall 59 of the inner portion 57 of the casing 13 located facing said outer wall 22 are parallel. Such a configuration also contributes to limiting the bulk of the casing 13. More particularly, in the embodiment shown in FIGS. 1 to 4, the outer wall 22 of the front pouring compartment 25 extends substantially parallel to the passage plane of the strip 1. The side wall 59 of the lower portion 57 extends in the extension of the side wall 53 of the upper portion 45, and extends substantially parallel to the passage plane of the strip 1.

The outer walls 22, 28 of the pouring compartments 25, 29 extend laterally inwardly relative to the side walls 58, 59 of the lower portion 57.

The apparatus 10 according to the invention makes it possible to obtain coated metal strips 1 having a considerably lower defect density on each of their faces, and the appearance quality thus obtained of this coating is suitable for the criteria required to have parts with surfaces free of appearance defects.

Indeed, owing to the presence of the two pouring compartments 25, 29 on either side of the strip 1 and the system for maintaining an appropriate liquid metal level in these compartments 25, 29, the liquid seal surface 14 is cleaned continuously and on each side of the strip 1 of zinc oxides and mattes that may float there and that could create appearance defects in the coating.

Furthermore, the pivoting nature as a whole of the casing 13 and the pouring box 49 around the first rotation axis A1 and the pivoting mounting of the pouring body 49 on the casing 13 around the second rotation axis A2 make it possible to minimize the appearance defects of the coating on the two faces of the strip 1 independently of the position or characteristics of the bottom roller 15, and in particular in case of change in the characteristics or position of this roller 15.

Indeed, the passage plane of the strip 1 through the casing 13 is determined by the position of the bottom roller 15 in the liquid metal bath 12, as well as by the diameter of the bottom roller 15. Thus, each change of the bottom roller 15 is able to modify the passage line of the strip 1 in the casing 13, and therefore to off-center the pouring compartments 25, 29 relative to the strip 1. Likewise, the wear of the bottom roller 15 during the operation of the apparatus 1, which results in a reduction in its diameter, is also reflected by a change in the passage line of the strip 1 in the casing 13, and therefore an off-centering of the pouring compartments 25, 29 relative to the strip 1.

It is important for the passage line of the strip 1 to be substantially centered between the two pouring compartments 25, 29. Otherwise, the strip 1 risks touching the inner walls 20, 26 of these compartments 25, 29 when it travels through the casing 13.

The pivoting of the casing 13 and the pouring box 49 around the first rotation axis A1 makes it possible to re-center the pouring compartments 25, 29 relative to the strip 1 in case of change in the characteristics or position of the bottom roller 15.

However, the inventors of the present invention have noted that such centering by rotation around a rotation axis A1 has the drawback of changing the altimetry of the upper rims 21, 27. In other words, the rotation of the casing 13 around a rotation axis A1 causes a rotation of the upper rims 21, 27 of the compartments 25, 29 around a rotation axis A1, and one of these rims 21, 27 is then at a higher altitude than the other. Yet such a difference in altitude must be controlled, since an uncontrolled difference in altitude risks resulting in an imbalance of the pouring flow rates into the compartments 25, 29 from the liquid seal surface 14. At a constant pump 30 flow rate, such an imbalance in flow rates risks leading to an overflow of one of the compartments 25, 29, the mattes and oxides stored in said compartment 25, 29 then being in contact with the strip 1, and thus risking reducing the quality of the coating.

The apparatus 10 as described above makes it possible to resolve this drawback owing to the possibility of pivoting of the pouring box 49 relative to the casing 13 around the second rotation axis A2, such pivoting making it possible to reestablish the horizontality of the pouring box 49 and thus resulting in rebalancing of the pouring flow rates into each of the compartments 25, 29.

Furthermore, providing that the casing 13 and the pouring box 49 are made in two separate parts, the casing 13 and the pouring box being fixed in rotation around the first rotation axis A1 in order to center the strip 1, and the pouring box 49 being mounted rotating around a rotation axis A2 relative to the casing 13 by means of a bearing precisely defining the position of the rotation axis A2 relative to the casing 13, makes it possible to perform, very precisely and independently, on the one hand the centering of the pouring box 49 relative to the metal strip 1, and on the other hand the balancing of the flow rates between the two pouring compartments 25, 29.

In particular, the mechanism described in view of the first embodiment is much simpler and makes it possible to position the casing 13 relative to the strip 1 and to balance the flow rates much more precisely and flexibly than the structures described in the prior patent applications WO 02/38823 and KR 10-1533212.

Experiments done by the inventors have shown that small angular movements around the first and second rotation axes A1 and A2, in particular of a few degrees, are sufficient to obtain a satisfactory adjustment of the coating apparatus 10.

The small angular movement required around the first rotation axis A1 is advantageous inasmuch as the coating apparatus 10 is generally located in a cluttered environment, not allowing substantial angular movements of the casing 13 as a whole.

Furthermore, the small angular movement necessary for the rotation of the pouring box 49 makes it possible to authorize the rebalancing, while maintaining good sealing between the pouring box 49 and the casing 13, by simply providing, between the pouring box 49 and the casing 13, a sealing gasket 60 deformable enough to allow the angular travel of the pouring box 49.

On the contrary, in the apparatuses described in WO 02/38823 and KR 10-1533212, which do not include a separate rotation axis of the pouring box 49 relative to an upper portion of the casing 13, much greater movements will be necessary to obtain the desired adjustment.

The implementation of a separate rotation axis A2 of the pouring box 49 relative to an upper portion of the casing 13 according to the invention further increases the adjustment span relative to the apparatuses described in WO 02/3823 and KR 10-1533212. Indeed, in the prior apparatuses, the possible adjustment angle is limited by the maximum possible rotation angle of the casing around the single rotation axis based on the position of the strip and the constraints of the system.

A method for continuous hot dip coating of a metal strip 1 using the apparatus 10 according to the first embodiment will now be explained.

This method includes adjusting the coating apparatus 10, in particular after changing the bottom roller 15.

During a step for adjusting the position of the pouring box 49 relative to the metal strip 1, and more particularly for centering said box 49 relative to the metal strip 1, the casing 13 is rotated around the first rotation axis A1 so as to center the metal strip 1 relative to the upper rims 21, 27 of the pouring compartments 25, 29.

Advantageously, during this step, the relative position of the upper rims 21 and 27 with respect to the metal strip 1 is detected using the viewing tool 42 and the movement of the casing 13 is controlled based on the position thus determined.

According to one embodiment, the rotational movement of the casing 13 is controlled by an operator acting on the first actuator 41 based on the respective position of the upper rims 21 and 27 and the metal strip 1 determined using the viewing tool 42. The operator may be a person or a computer.

Alternatively, the positioning of the pouring box 49 relative to the strip 1 is done automatically by control means configured to control the first actuator 41 based on the relative positions determined using the viewing tool 42.

During a rebalancing step, following the adjusting step, the pouring box 49 is rotated relative to the upper portion 45 of the casing 13 around the second rotation axis A2 so as to make the pouring box 49 horizontal.

More particularly, during this step, the pouring box 49 is rotated around the second rotation axis A2 relative to the lower portion 57 of the casing 13.

According to one embodiment, during this step, the control means control the rotation of the pouring box 49 based on measurements taken by the incline sensor 72.

Alternatively, this rotation is controlled by an operator acting on the second actuator 71 based on the incline measured by the incline sensor 72 or observed by the operator.

At the end of this second step, the strip 1 is substantially centered relative to the upper rims 21, 27 and these rims 21, 27 are arranged in a same horizontal plane.

Optionally, if the positioning is not satisfactory at the end of the second step, the centering step is reiterated, and optionally the rebalancing step, as often as necessary in order to obtain a satisfactory positioning of the upper rims 21, 27 relative to the strip 1.

In order to verify whether the positioning is satisfactory, it is possible to run the coating apparatus 10 in order to verify, on the one hand, whether the strip 1 touches the upper rims 21, 27 during its scrolling, and on the other hand, whether the pouring flow rate is well-balanced between the two pouring compartments 25, 29.

If centering or horizontality defects are observed at this stage, the apparatus 10 is stopped, and the centering and rebalancing steps are carried out again.

According to one embodiment, before the first centering step above, the horizontality of the upper rims 21, 27 is adjusted using the mechanism for adjusting the horizontality of said rims 21, 27. More particularly, during this step, one acts on the rotation axis A2 so as to adjust its horizontality.

As an example, during this step, the surface of the liquid metal bath 12 is chosen as horizontality reference to carry out this adjustment.

The adjustment of the horizontality of the upper rims 21, 27 is in particular carried out after replacing the pouring box 49.

Optionally, before the first centering step above, the casing 13 is translated along its axis so as to adjust its immersion height in the liquid metal bath 12. Such an adjustment is known and will not be described in detail in this patent application.

It will be noted that the invention applies to any metal coating by dipping.

Figure 6:
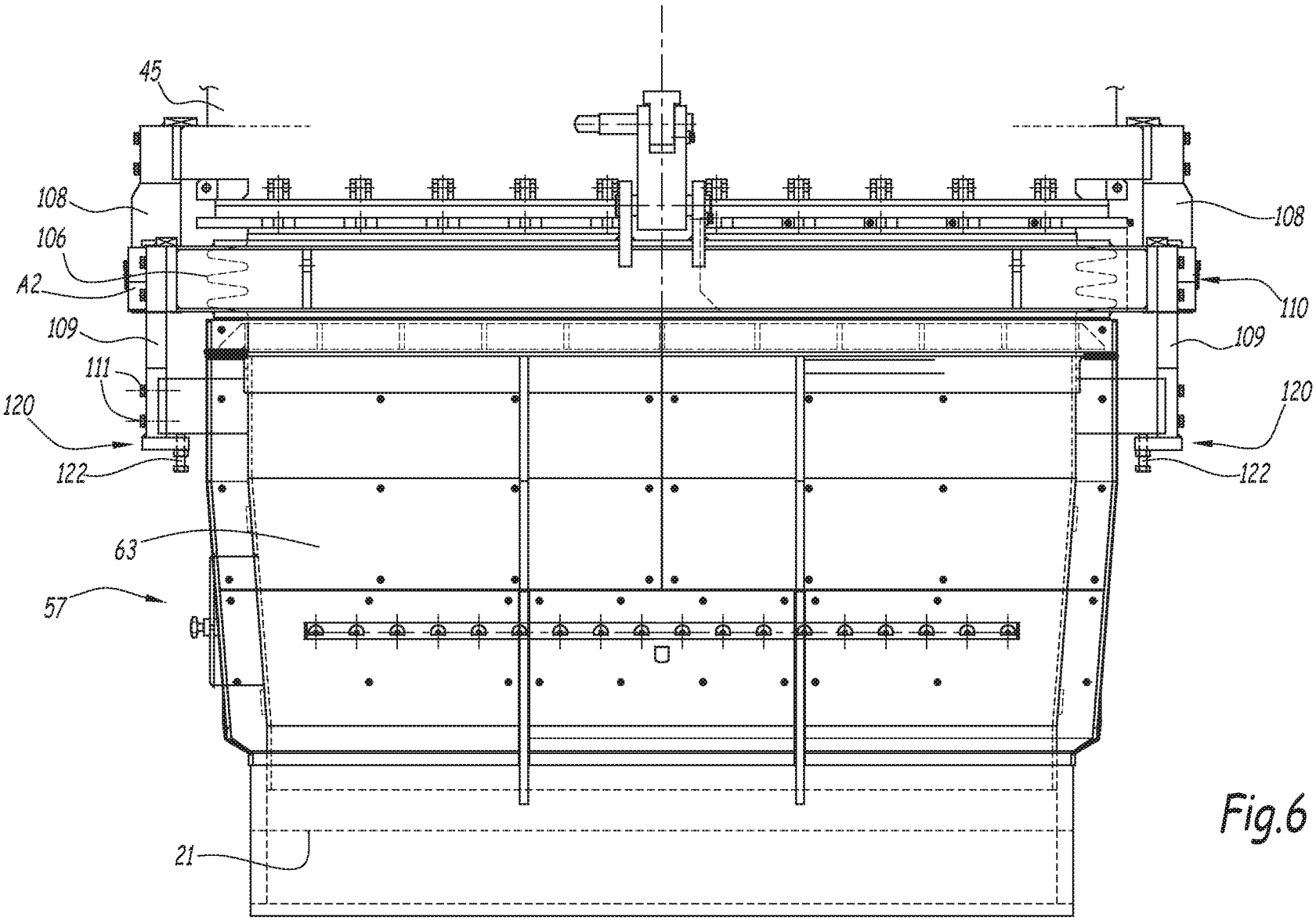
FIG. 6 is a schematic view along III of part of the coating apparatus of FIG. 5.

An apparatus 100 according to a second embodiment will now be described in reference to FIGS. 5 and 6. Only the differences with respect to the first embodiment will be described. In FIGS. 5 and 6, the identical or similar elements bear numerical references identical to those used for the first embodiment.

The apparatus 100 according to the second embodiment differs from the apparatus 10 in particular by the location of the second rotation axis A2.

As previously explained, in the first embodiment, the pouring box 49 is carried by the lower portion 57 of the casing 13 while being mounted rotating on the latter around the second rotation axis A2.

In the apparatus 100 according to the second embodiment, and as shown in FIG. 5, the pouring box 49 is carried by the lower portion 57 of the casing 13 while being stationary relative thereto. The lower portion 57 of the casing 13 is in turn mounted rotating on the upper portion 45 of the casing 13 around a second rotation axis A2. Thus, the pouring box 49 is rotatable around the rotation axis A2 relative to the upper portion 45 of the casing 13.

More specifically, in this embodiment, the outer walls of the pouring box 49 formed by the outer walls 22, 28 of the pouring compartments 25, 29 are formed by the side walls 58, 59 of the lower portion 57 of the casing 13. Thus, the pouring box 49 is, in this embodiment, integrated into the lower portion 57 of the casing 13.

As shown in FIGS. 5 and 6, the lower portion 57 of the casing 13 is articulated on the upper portion 45 of the casing 13 via a pivot link allowing the rotation of the pouring box 49 relative to the upper portion 45 of the casing 13 around the second rotation axis A2.

As shown in FIG. 5, the rotation axis A2 passes through the walls of the casing 13.

In this apparatus 100, the second rotation axis A2 is located outside the liquid metal bath 12. In particular, the second rotation axis A2 is located above the pouring compartments 25, 29.

In particular, the distance d1, d2 between the second rotation axis A2 and each of the rims 21, 27 of the pouring compartments 25, 29 is less than or equal to 2500 mm. This distance is advantageously between 800 mm and 1400 mm.

More particularly, the apparatus 100 includes two shaft segments 110 defining the rotation axis A2.

In the embodiment illustrated in FIGS. 5 and 6, the articulation allowing the rotation around the second rotation axis A2 is formed outside the passage channel of the strip 1 delimited by the casing 13. In particular, it is formed on the casing 13.

In this embodiment, the upper portion 45 of the casing 13 is provided with two upper articulation arms 108. Each of these upper articulation arms 108 receives, at its lower end, a shaft segment 110, said shaft segment 110 rotatably receiving a lower articulation arm 109 secured to the lower part 57 of the casing.

The articulation arms 108, 109 more particularly assume the form of articulation yokes rotatably connected via the shaft segment 110.

Alternatively, any other articulation mechanism creating a pivot link between the pouring box 49 and the upper portion 45 of the casing 13 around a rotation axis A2 can be considered.

The second actuator 71 assumes the form of an actuating jack, arranged between the lower portion 57 and the upper portion 45 of the casing 13, so as to rotate the pouring box 49 around the second rotation axis A2 relative to the upper portion 45 of the casing 13. The second actuator 71 is in particular a screw jack. However, alternatively, the second actuator 71 is of any other suitable type, and for example includes a hydraulic or pneumatic jack.

Like in the first embodiment, the apparatus 100 further includes a measuring sensor configured to measure the incline angle of the pouring body 49 relative to the horizontal and means for controlling the second actuator 71, configured to control the second actuator 71 based on the incline angle measured by the measuring sensor 72.

In the second embodiment, the apparatus 100 further includes sealing means 106, arranged between the lower end of the upper portion 45 of the casing 13 and the upper end of the lower portion 57. The sealing means 106 are configured to prevent air from entering the casing 13 from the environment. The sealing means 106, for example, include a bellows extending between the lower end of the upper portion 45 and the upper end of the lower portion 57 of the casing 13.

The bellows also plays a compensating role allowing the relative movement of the lower portion 57 with respect to the upper portion 45 of the casing 13.

The apparatus 100 further includes a mechanism 120 for adjusting the horizontality of the upper rims 21, 27 of the inner walls 20, 26 of the compartments 25, 29.

One embodiment of such a mechanism 120 is more particularly illustrated in FIG. 6. In this embodiment, the mechanism 120 includes, on the side of each of the ends of the upper rims 21, 27, at least one adjusting screw 122 configured to adjust the height of said end. More particularly, each adjusting screw 122 is configured to act on a corresponding part of the lower portion 57 of the casing 13.

In the embodiment illustrated in FIG. 6, the adjusting screws 122 are provided at the lower articulation arm 109 of the articulation mechanism of the lower portion 57 on the upper portion 45 of the casing 13. They are arranged such that their screwing or unscrewing results in a vertical movement of the corresponding portion of the lower portion 57 relative to the lower articulation arm 109, and thus indirectly in an adjustment of the height of the corresponding end of the upper rims 21, 27. In this embodiment, the lower articulation arm 109 is secured to the lower portion 57 via securing screws 111 passing in oblong orifices of the lower articulation arm 109, thus making it possible to adjust the position of the lower portion 57 relative to the lower articulation arm 109.

In this embodiment, the lower portion 57 includes an upper segment and a lower segment, fastened on the upper segment. The upper segment is not intended to be immersed in the liquid metal bath 12. The lower segment is intended to be immersed at least partially in the liquid metal bath 12. The lower segment is in particular attached on the upper segment by welding. The outer walls 22, 28 of the pouring compartments 25, 29 are formed by the side walls of the lower segment of said lower portion 57.

As shown in FIG. 5, the pump 30 is partially immersed in the liquid metal bath 12. It is fixed in rotation relative to the pouring box 49 via a chassis 75 fastened on the lower portion 57 of the casing 13. The suction tubings 31, 32 are rigidly fastened between the pump 30 and the pouring box 49. Thus, the pump 30 and the suction tubings 31, 32 are rotatable with the pouring box 49 around the first rotation axis A1 relative to the frame 40 with the apparatus 100 and around the second rotation axis A2 relative to the upper portion 45 of the casing 13.

In the embodiment illustrated in FIG. 5, the orientations of the inner 20, 26 and outer 22, 28 walls of the compartments 25, 29 are similar to those described in view of the first embodiment, and generate the same advantages.

The apparatus 100 according to the second embodiment has most of the advantages provided by the apparatus 10 according to the first embodiment.

Furthermore, in this embodiment, the location of the second rotation axis A2 outside the liquid metal bath 12 is advantageous, since it avoids having to provide sealing between the pouring box 49 and the main descent 45 into the liquid metal bath.

Conversely, in this embodiment, in view of the location of the second rotation axis A2, the distance between the second rotation axis A2 and the rims 21, 27 of the pouring compartments 25, 29 is greater than this distance in the first embodiment, which risks increasing the overall bulk of the equipment 100.

The method for adjusting the apparatus 100 according to the second embodiment is similar to the method for adjusting the apparatus 10 according to the first embodiment. It will, however, be noted that during the step for rebalancing the flow rates, more particularly, the lower portion 57 of the casing 13 provided with its pouring box 49 is rotated around the second rotation axis A2 relative to the upper portion 45 of the casing 13.

Advantageously, the method for adjusting the apparatus 100 further includes a step for adjusting the horizontality of the upper rims 21, 27 via the adjusting mechanism 120. In particular, this step includes the screwing or unscrewing of the adjusting screws 122 based on any observed horizontality flaw of the rims 21, 27 so as to reestablish the horizontality of the rims 21, 27.

This adjustment is in particular done by using the surface of the liquid metal bath 12 as horizontality reference.

It is done by an operator, who may be a person or a computer.

The adjustment of the horizontality of the upper rims 21, 27 is in particular carried out after replacing the lower portion 57 of the casing 13 provided with its pouring box 49.

At the end of the step for adjusting the horizontality, each of the upper rims 21, 27 extends horizontally.

It will be noted that the invention described above in view of FIGS. 1 to 6 has two aspects, namely on the one hand the pivoting nature of the casing 13 and the pouring box 49 around the first rotation axis A1 and the rotatable mounting of the pouring box 49 relative to the upper portion 45 of the casing 13 around the second rotation axis A2, as well as the characteristics related to the adjustment of the apparatus 10, 100 resulting therefrom, and on the other hand the particular shape of the pouring compartments 25, 29.

As previously explained, the characteristics related to the first aspect make it possible to center the strip 1 in the casing 13 and balance the pouring flow rates in the two compartments simply, flexibly and precisely, thereby resulting in an excellent appearance quality of the coating on each of its faces.

Furthermore, the characteristics related to the second aspect, and in particular the orientation of the outer wall 28 of the compartment 29, make it possible to reduce the risks of liquid metal splashing on the strip 1, thereby also contributing to improving the appearance quality of the coating on the two faces of the strip, and in particular on the face of the strip oriented opposite the bottom roller 15.

Although described in combination in view of FIGS. 1 to 6, the first aspect may be implemented independently of the second aspect, the first aspect, considered alone, already contributing to a significant improvement in the quality of the coating.

Implemented together, the two aspects of the present invention lead to an even better appearance quality of the coating of the strip on each of its faces than when only one of these aspects is implemented.

What is claimed is:

1. An apparatus for continuous hot dip coating of a metal strip, comprising:

a vessel having a liquid metal bath;

a bottom roller arranged in the vessel, the bottom roller for immersing in the liquid metal bath;

a displacement casing for the metal strip, the displacement casing having a lower end for immersing in the liquid metal bath to define a liquid metal seal with a surface of the liquid metal bath and an inside of the displacement casing;

the displacement casing including an upper portion and a lower portion, the lower portion bearing a pouring box delimiting at least two liquid metal pouring compartments, each of the at least two liquid metal pouring compartments being inwardly delimited by an inner wall, the inner walls including an upper rim, the upper rim of each inner wall being arranged below the liquid metal seal to produce a flow from the liquid metal seal into each of the at least two liquid metal pouring compartments, the displacement casing with the pouring box being rotatable relative to the metal strip around a first rotation axis; and the pouring box being rotatable relative to the upper portion of the displacement casing around a second rotation axis, the second rotation axis being substantially parallel to the first rotation axis, wherein an articulation allowing rotation of the pouring box relative to the upper portion of the displacement casing is a pivot link, the pivot link including a pivot extending longitudinally along the second rotation axis; wherein said pivot link rotatably attaches the pouring box to the lower portion of the displacement casing or rotatably attaches the lower portion of the displacement casing to the upper portion of the displacement casing.

2. The apparatus as recited in claim 1, wherein a distance between the second rotation axis and each upper rim of each inner wall is less than or equal to 2500 mm.

3. The apparatus as recited in claim 1 further comprising:

at least one pump to extract a liquid metal from the at least two liquid metal pouring compartments;

at least one suction tubing connecting each of the at least two liquid metal pouring compartments to the at least one pump; and a discharge tubing for discharging the liquid metal from the at least two liquid metal pouring compartments into the liquid metal bath, wherein the at least one pump, the at least one suction tubing and discharge tubing being mounted stationary relative to the pouring box.

4. The apparatus as recited in claim 1, further comprising:

a first actuator for rotating the displacement casing around the first rotation axis relative to the metal strip; and a second actuator for rotating the pouring box relative to the upper portion of the displacement casing around the second rotation axis.

5. The apparatus as recited in claim 4, further comprising:

an incline sensor to measure an incline angle of the pouring box relative to a horizontal plane.

6. The apparatus as recited in claim 5, further comprising:

a controller for the second actuator based on the incline angle measured by the incline sensor.

7. The apparatus as recited in claim 1, further comprising:

a viewing tool for viewing a position of each inner wall of the at least two liquid metal pouring compartments relative to the metal strip.

8. The apparatus as recited in claim 1, further comprising:

a reservoir for viewing a level of a liquid metal in the at least two liquid metal pouring compartments, the reservoir arranged outside the displacement casing and connected to a base of each of the at least two liquid metal pouring compartments by at least one connecting pipe, the reservoir is mounted stationary relative to the pouring box.

9. The apparatus as recited in claim 1, further comprising:

an adjustment device to adjust a horizontality of the upper rims of each inner wall of the pouring boxes.

10. The apparatus as recited in claim 1, wherein the pouring box is stationary relative to the lower portion of the displacement casing and the lower portion of the displacement casing is mounted rotatably around the second rotation axis on the upper portion of the displacement casing.

11. The apparatus as recited in claim 10, wherein outer walls of the pouring box are formed by side walls of the lower portion of the displacement casing.

12. The apparatus as recited in claim 10, wherein the second rotation axis is located outside the liquid metal bath.

13. The apparatus as recited in claim 10, wherein the pivot link includes an upper articulation arm secured to the upper portion of the displacement casing and a lower articulation arm secured to the lower portion of the displacement casing, the upper and lower articulation arms being rotatably connected via the pivot, the pivot being a shaft segment.

14. The apparatus as recited in claim 1, wherein the pouring box is rotatably mounted on the lower portion of the displacement casing.

15. The apparatus as recited in claim 14, wherein the pouring box is inserted into the displacement casing at the lower end thereof.

16. An apparatus for continuous hot dip coating of a metal strip, comprising:

a vessel having a liquid metal bath;

a bottom roller arranged in the vessel, the bottom roller for immersing in the liquid metal bath;

a displacement casing for the metal strip, the displacement casing having a lower end for immersing in the liquid metal bath to define a liquid metal seal with a surface of the liquid metal bath and an inside of the displacement casing;

the displacement casing including an upper portion and a lower portion, the lower portion bearing a pouring box delimiting at least two liquid metal pouring compartments, each of the at least two liquid metal pouring compartments being inwardly delimited by an inner wall, the inner walls including an upper rim, the upper rim of each inner wall being arranged below the liquid metal seal to produce a flow from the liquid metal seal into each of the at least two liquid metal pouring compartments, the displacement casing with the pouring box being rotatable relative to the metal strip around a first rotation axis; and the pouring box being rotatable relative to the upper portion of the displacement casing around a second rotation axis, the second rotation axis being substantially parallel to the first rotation axis, wherein the pouring box is rotatably mounted on the lower portion of the displacement casing, wherein one of the lower portion of the displacement casing or the pouring box includes rotational guide bearings, and another one of the lower portion of the displacement casing or the pouring box includes journals, each journal being received in a respective guide bearing to provide rotational guiding of the pouring box around the second rotation axis.

17. The apparatus as recited in claim 14, wherein the second rotation axis is configured to be immersed in the liquid metal bath.

18. The apparatus as recited in claim 17, further comprising:

a sealing gasket arranged between the pouring box and the lower portion of the displacement casing in order to prevent a liquid metal from penetrating between the pouring box and the displacement casing.

19. The apparatus as recited in claim 14, wherein the second rotation axis is arranged below the upper rim of each of the at least two liquid metal pouring compartments when the pouring box is horizontal.

20. The apparatus as recited in claim 1, wherein one of the at least two liquid metal pouring compartments is a rear pouring compartment located on a side of a face of the metal strip placed opposite the bottom roller, and the rear pouring compartment is outwardly delimited by an outer wall, the apparatus being configured for operating in a usage configuration in which the metal strip travels through the apparatus and is hot dip coated by passing through a liquid metal in the liquid metal bath, the outer wall and a passage plane of the metal strip form, in the usage configuration of the apparatus, an angle greater than zero.

21. The apparatus as recited in claim 20, wherein the outer wall of the rear pouring compartment is vertical in the usage configuration of the apparatus.

22. A method for continuous hot dip coating of the metal strip using the coating apparatus as recited in claim 1, comprising:

positioning the pouring box relative to the metal strip by rotating the displacement casing and the pouring box around the first rotation axis to position the metal strip relative to the upper rim of each of the at least two liquid metal pouring compartments; and rebalancing by rotating the pouring box around the second rotation axis relative to the upper portion of the displacement casing to make the pouring box horizontal.

23. The method as recited in claim 22, further comprising:

adjusting a horizontality of the upper rims of each of the inner wall of each of the at least two liquid metal pouring compartments.

24. The method as recited in claim 22, further comprising:

depositing a coating comprising zinc and aluminum on the metal strip.

25. The method as recited in claim 22, further comprising:

depositing a zinc-based coating comprising aluminum on the metal strip.

26. The method as recited in claim 25, wherein the zinc-based coating includes between 0.1 and 0.3 wt % aluminum.

27. The method as recited in claim 25, wherein the zinc-based coating includes 5 wt % aluminum and a remainder is zinc.

28. The method as recited in claim 22, further comprising:

depositing a zinc-based coating including magnesium on the metal strip.

29. The method as recited in in claim 22, further comprising:

depositing an aluminum-based coating including silicon and iron on the metal strip.

30. The method as recited in claim 25, wherein the zinc-based coating includes 55 wt % of aluminum, 43.5 wt % of zinc and 1.5 wt % of silicon.

31. The method as recited in claim 28, wherein the zinc-based coating includes from 0.1 to 20 wt % of aluminum and from 0.1 to 10 wt % of magnesium.

32. The method as recited in claim 28, wherein the zinc-based coating includes 55 wt % of aluminum, 43.5 wt % of zinc and 1.5 wt % of silicon.

33. The method as recited in claim 29, wherein the aluminum-based coating includes, in wt %:

$$8\% \leq Si \leq 11\%; \text{ and}$$

$$2\% \leq Fe \leq 4;$$

a remainder being aluminum and any impurities.

34. The apparatus as recited in claim 20, wherein the angle is greater than 15°.

35. The method as recited in claim 28, wherein the zinc-based coating includes aluminum.

36. The apparatus as recited in claim 1, wherein the pivot is a shaft, shaft segment or journal received in a bearing.

* * * * *